US006634041B2

(12) United States Patent
Higashi et al.

(10) Patent No.: US 6,634,041 B2
(45) Date of Patent: Oct. 21, 2003

(54) CONVERTIBLE TOWEL TO TOTE BAG ARTICLE AND METHOD OF MAKING SAME

(76) Inventors: Randy Higashi, 14604 Rosecrans Ave., La Mirada, CA (US) 90638; Peter Algarin, 14604 Rosecrans Ave., La Mirada, CA (US) 90638

( * ) Notice: Subject to any disclaimer, the term of this patent is extended or adjusted under 35 U.S.C. 154(b) by 16 days.

(21) Appl. No.: 10/053,955

(22) Filed: Jan. 24, 2002

(65) Prior Publication Data

US 2003/0135925 A1 Jul. 24, 2003

(51) Int. Cl.[7] ..... A47G 9/06
(52) U.S. Cl. ..... 5/417; 5/656; 5/485; 383/4
(58) Field of Search ..... 5/417, 419, 485, 5/502, 656; 383/4

(56) References Cited

U.S. PATENT DOCUMENTS

| | | | | | |
|---|---|---|---|---|---|
| 2,264,471 | A | * | 12/1941 | Glenn | 5/419 |
| 3,041,638 | A | | 7/1962 | Lo Vico | |
| 3,052,895 | A | | 9/1962 | Lo Vico | |
| 3,489,194 | A | | 1/1970 | Hoover | |
| 4,375,111 | A | * | 3/1983 | Hall | 5/419 |
| 4,671,393 | A | | 6/1987 | Rainey | |
| 4,723,300 | A | | 2/1988 | Aranow | |
| 4,991,245 | A | | 2/1991 | Franco | |
| 5,110,219 | A | | 5/1992 | Lopes | |
| 5,244,278 | A | * | 9/1993 | Robitaille | 383/4 |
| 5,577,730 | A | | 11/1996 | Vannozzi, Sr. | |
| 5,843,556 | A | * | 12/1998 | Levas | 428/99 |
| 6,053,634 | A | | 4/2000 | Kay | |
| 6,129,452 | A | * | 10/2000 | Hakulin | 383/4 |
| 6,408,462 | B1 | * | 6/2002 | Moore | 5/417 |

* cited by examiner

*Primary Examiner*—Michael F. Trettel
(74) *Attorney, Agent, or Firm*—Gary Appel

(57) ABSTRACT

A towel to tote bag convertible article is disclosed that comprises a towel, preferably a sports towel, having a first end region, a second end region and an intermediate region between the first and second end regions. A pocket provided at and across the first end region, has an opening facing the second end region and is sized to receive and contain the second end region and the intermediate region, the pocket being configured for being turned inside out to form a tote bag containing the second end region and the intermediate region. A zipper is provided for enabling the closing of the pocket opening before and after the pocket is turned inside out. A decorative or waterproof lining may be attached to the pocket to form the outside of the tote bag when the pocket is turned inside out. A tote bag carrying strap is installed inside the pocket. A method of making the convertible article is also disclosed.

14 Claims, 2 Drawing Sheets

CONVERTIBLE TOWEL TO TOTE BAG ARTICLE AND METHOD OF MAKING SAME

BACKGROUND OF THE INVENTION

1. Field of the Invention

The present invention relates generally to the field of linen goods, more particularly to towels, and still more particularly to combination towels and tote bags.

2. Background Discussion

The difficulties associated with bringing such amenities or necessities as a large sports towel, jewelry, keys, wallets, reading materials, and various electronic gear to a gym, beach outing, or picnic are well known to many people. Not only must an individual carry such articles to and from a gym, beach, or picnic, but also the individual needs to keep the articles readily accessible while on the beach or at the picnic. The difficulties are exacerbated if the individual also has his or her hands occupied, for example, with carrying a food hamper or ice chest.

Various types of "carry-alls" are, of course, available, including tote bags and satchels, not to mention the ubiquitous plastic and paper grocery bags. However such known "carry-alls" are often inconvenient to carry and are often unattractive and/or are not "cool." In addition, "carry-alls" known to the present inventor do not have any function other than carrying articles.

For these and other reasons, the present inventor has invented a novel towel, for example, a sports towel, having a pocket that converts the towel into a tote bag for carrying the towel and other objects.

SUMMARY OF THE INVENTION

In accordance with the present invention, a towel to tote bag convertible article comprises a towel having a first end region, a second end region and an intermediate region between the first and second end regions. A pocket formed at and across the towel first end region has an opening facing the second end region and is sized to receive and contain the second end region and the intermediate region. The pocket is configured for being turned inside out to form a tote bag containing the towel second end region and the intermediate region. Included are closure means, preferably a zipper, for enabling the closing of the pocket opening before and after the pocket is turned inside out.

Preferably, the convertible article includes a lining attached to the pocket, the lining forming the outside of the tote bag when the pocket is turned inside out. The lining may be constructed from a waterproof material.

Also preferably the convertible article includes a tote bag carrying strap attached to the inside of the pocket, and the towel comprises a terry cloth sports towel.

More particularly, a towel to tote bag convertible article comprises a sports towel having a first end region, a second end region and an intermediate region between the first and second end regions. A pocket is formed at and across the first end region, the pocket having an opening facing the second end region and being sized to receive and contain the second end region and the intermediate region, the pocket being configured for being turned inside out to form a tote bag containing the second end region and the intermediate region.

Included is a tote bag carrying strap attached to the inside of the pocket. A zipper is attached to the towel and to the pocket at the pocket opening for enabling the closing of the pocket opening before and after the pocket is turned inside out. Also included is a lining attached to the pocket, said lining, which may be constructed of a decorative or waterproof material, forming the outside of the tote bag when the pocket is turned inside out.

There is provided a corresponding method for constructing a towel, which may be a sports towel, that converts into a tote bag, the method comprising the steps of forming a towel having a first end region, a second end region and an intermediate region between the first and second end regions; making a pocket at the first end region having an opening facing the second end region and extending across the first end region and of sufficient size to receive and contain the second end region and the intermediate region.

Included are the steps of forming a tote bag by turning the pocket inside out with the second end region and the intermediate region contained in the tote bag; and of providing a common closure for the pocket and the tote bag.

Preferably, also included are the steps of attaching a tote bag carrying strap to the inside of the pocket and of attaching a lining, which may be made of a decorative material or a waterproof material, inside the pocket, the lining forming the outside of the tote bag when the pocket is turned inside out.

BRIEF DESCRIPTION OF THE DRAWINGS

The present invention can be more readily understood by a consideration of the following detailed description when taken in conjunction with the accompanying drawings, in which.

In the various FIGS., the same elements and features are given the same reference numbers.

DESCRIPTION OF THE PREFERRED EMBODIMENT

Figure 1:
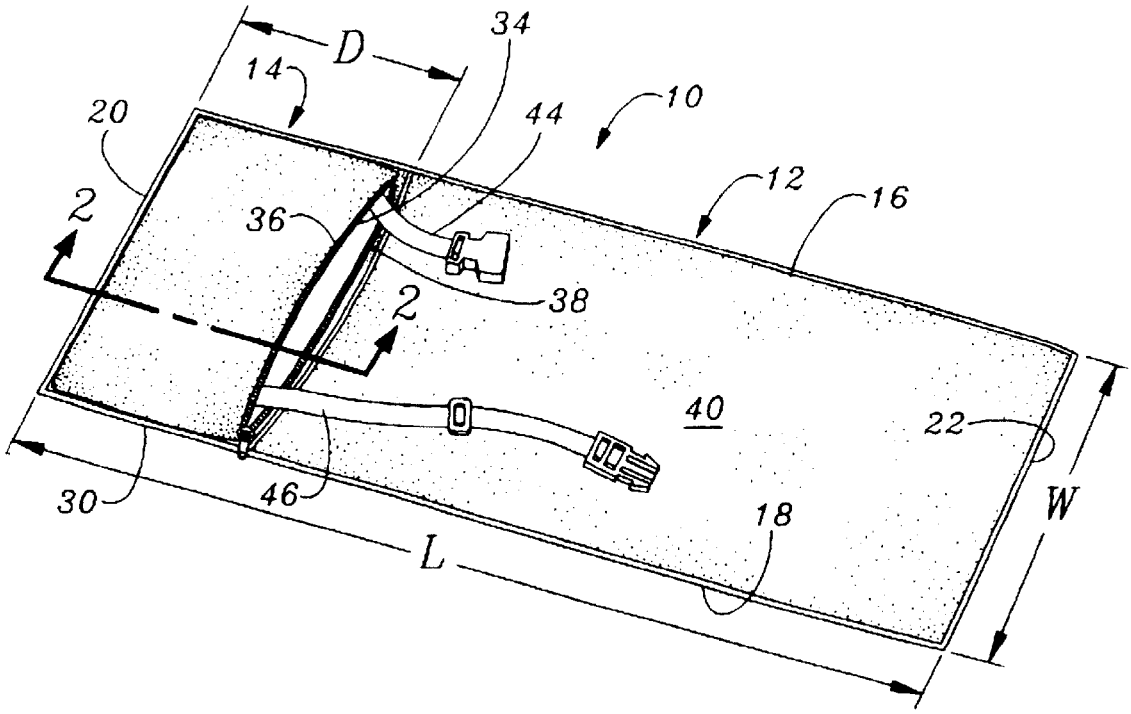
FIG. 1 is a perspective drawing of the convertible towel in accordance with the present invention showing a pocket formed in one end region of the towel, showing a zipper closure for the pocket and showing tote bag carrying straps extending from inside the pocket.

Shown in perspective in FIG. 1 is a convertible towel to tote bag article 10 in accordance with a preferred embodiment of the invention. Convertible article 10 converts, in the manner described below, into a tote bag. Shown comprising convertible article 10 are a towel 12 and a pocket 14. Towel 12 is formed of a rectangular piece of a fabric, such as a heavy cotton towel fabric or a terrycloth material.

Towel 12 has respective first and second long side edges 16 and 18 and has a length, L, that may, for example, be about 72 inches. In addition, towel 12 has respective first and second short end edges 20 and 22 and has a width, W, that may, for example, be about 36 to 38 inches and width, W, is between about 13½ inches and about 14 inches.

Figure 2:
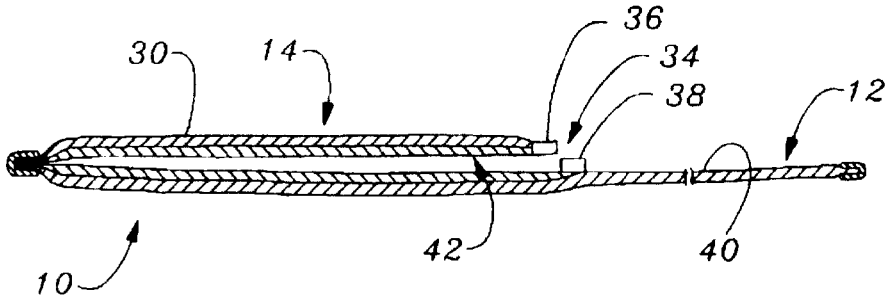
FIG. 2 is a cross sectional drawing, taken along line 2—2 of FIG. 1 showing features of the pocket.

Pocket 14 is shown as a flat pocket, but alternatively may be of an expandable "cargo" type. As shown in FIGS. 1 and 2, pocket 14 is formed by attaching a piece of fabric 30 across a first end region of towel 12, for example by sewing edges of the fabric piece to towel end 22 and along towel side edges 16 and 18. Alternatively, fabric piece 30 may comprise a folded over end of towel 14. Pocket 14 has a depth, D, that may, for example, be about 12 to about 18 inches and has an opening 32 that faces towel second end 22. A pocket closure zipper 34 is provided for closing pocket opening 32, a first zipper half 36 being sewn to an edge of fabric piece 30 at opening 32 and a mating, second zipper half 38 being sewn at an upper surface 40 of towel 12 adjacent the first zipper half.

As shown in FIG. 2 pocket 14 may include a sewn in lining 42 that forms an inside of the pocket. Lining 42 may be formed of a waterproof material, of a decorative material, or of a decorative waterproof material. Respective first and second carrying strap sections 44 and 46 (FIG. 1) are each attached at one end inside pocket 14.

Figure 3:
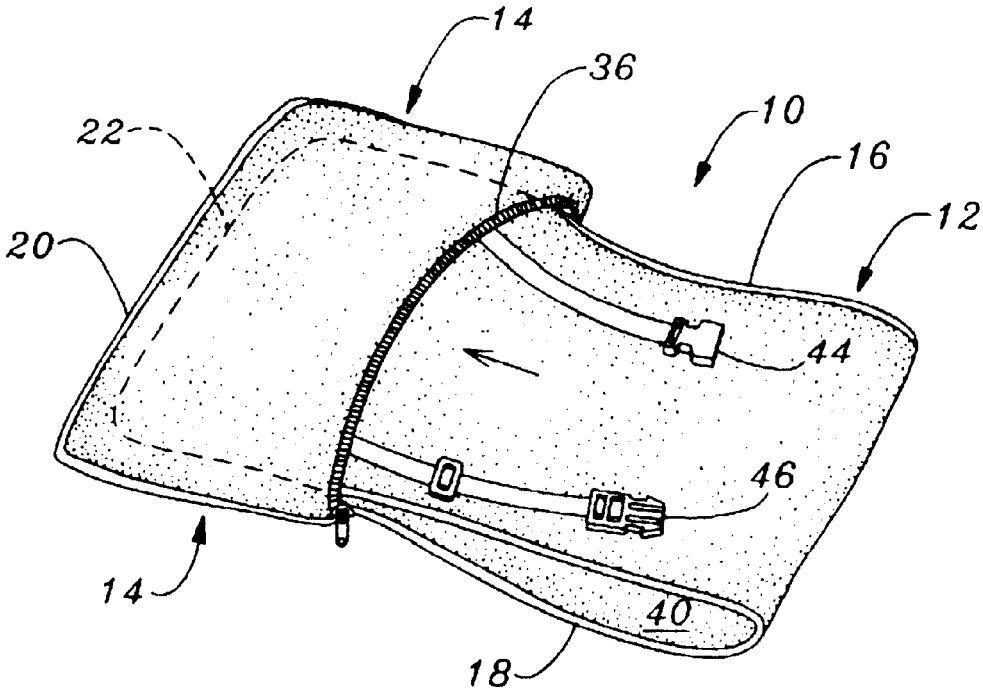
FIG. 3 is a perspective drawing similar to FIG. 1, showing regions of the towel in the process of being tucked into the pocket.

A first step of converting article 10 into a tote bag is depicted in FIG. 3. A region of towel 12 adjacent second towel end 22 is inserted into pocket 14. The exposed towel region intermediate first and second ends 20 and 22 are then tucked into the pocket until the entire, previously exposed region of towel 12 is stowed inside pocket 30.

Figure 4:
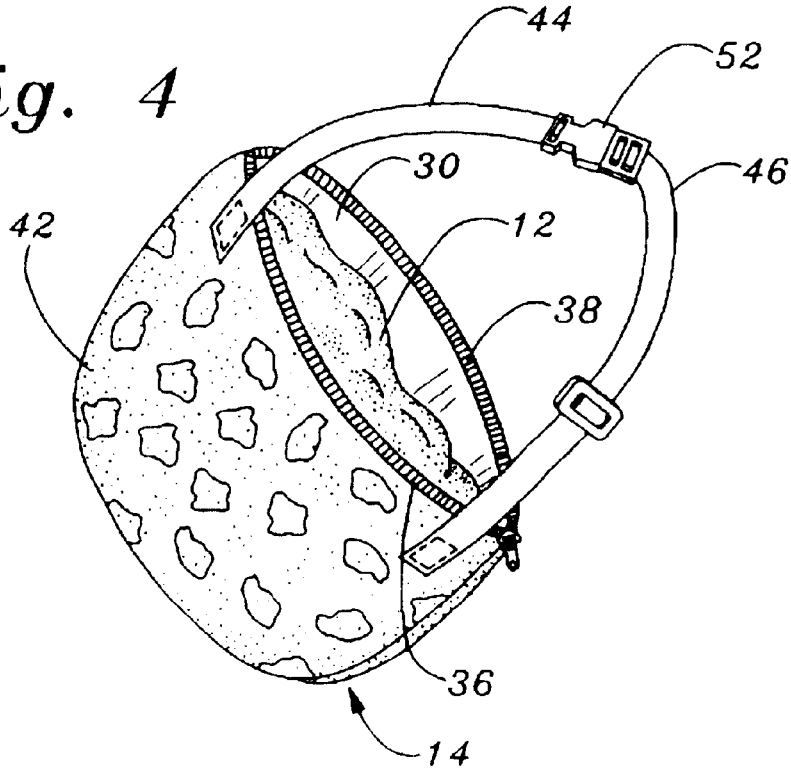
FIG. 4 is a partially cutaway perspective drawing showing the pocket turned inside out to form a tote bag with regions of the towel retained inside the tote bag.

Pocket 30 is then turned inside out to form tote bag 50 (FIG. 4) with towel 12 contained inside, and with lining 42 now forming the outside of the tote bag. Carrying strap sections 44 and 46 are now completely exposed and may be joined together by a buckle 52. As depicted, zipper halves 36 and 38 will now line up and pocket (now tote bag) opening 30 (shown open) may be zippered closed.

Although there has been described above a towel that is convertible into a tote bag in accordance with the present invention for purposes of illustrating the manner in which the present invention maybe used to advantage, it is to be understood that the invention is not limited thereto. Consequently, any and all variations and equivalent arrangements, which may occur to those skilled in the applicable art, are to be considered to be within the scope and spirit of the invention as set forth in the claims that are appended hereto as part of this application.

What is claimed is:

1. A towel to tote bag convertible article, said article comprising:

a. a towel having a first end region, a second end region and an intermediate region between said first and second end regions;

b. a pocket formed at and across said first end region, said pocket having an opening facing said second end region and being sized to receive and contain said second end region and said intermediate region, said pocket being configured for being turned inside out to form a tote bag containing said second end region and said intermediate region;

c. closure means for enabling the closing of said pocket opening before and after said pocket is turned inside out: and d. a tote bag carrying strap attached to the inside of said pocket.

2. The convertible article as claimed in claim 1, including a lining attached to said pocket, said lining forming the outside of said tote bag when said pocket is turned inside out.

3. The convertible article as claimed in claim 2, wherein said lining is constructed from a waterproof material.

4. The convertible article as claimed in claim 1, wherein said towel comprises a terry cloth beach towel.

5. The convertible article as claimed in claim 1, wherein said closure means comprises a zipper.

6. A towel to tote bag convertible article, said article comprising:

a. a sports towel having a first end region, a second end region and an intermediate region between said first and second end regions;

b. a pocket formed at and across said first end region, said pocket having an opening facing said second end region and being sized to receive and contain said second end region and said intermediate region, said pocket being configured for being turned inside out to form a tote bag containing said second end region and said intermediate region;

c. a tote bag carrying strap attached to the inside of said pocket; and d. a zipper attached to said towel and to the pocket at said opening for enabling the closing of the pocket opening before and after the pocket is turned inside out.

7. The convertible article as claimed in claim 6, including a lining attached to said pocket, said lining forming the outside of said tote bag when said pocket is turned inside out.

8. The convertible article as claimed in claim 7, wherein said lining is constructed from a decorative material.

9. The convertible article as claimed in claim 7, wherein said lining is constructed from a waterproof material.

10. A method for constructing a towel that converts into a tote bag, said method comprising the steps of:

a. forming a towel having a first end region, a second end region and an intermediate region between said first and second end regions;

b. making a pocket at said first end region having an opening facing said second end region and extending across the first end region and of sufficient size to receive and contain said second end region and said intermediate region;

c. forming a tote bag by turning said pocket inside out with said second end region and said intermediate region contained in said tote bag;

d. providing a common closure for said pocket and said tote bag; and e. attaching a tote bag carrying strap to the inside of said pocket.

11. The method as claimed in claim 10, including the step of attaching a lining inside said pocket, said lining forming the outside of the tote bag when the pocket is turned inside out.

12. The method as claimed in claim 11, including making the lining of a decorative material.

13. The method as claimed in claim 11, including making the lining of a waterproof material.

14. The method as claimed in claim 10, wherein the step of making a towel includes making the towel a sports towel.

* * * * *